United States Patent [19]

Bohlayer

[11] 4,384,408

[45] May 24, 1983

[54] COLUMNAR SUNDIAL

[76] Inventor: William L. Bohlayer, P.O. Box 715, Middleburg, Va. 22117

[21] Appl. No.: 295,409

[22] Filed: Aug. 24, 1981

[51] Int. Cl.[3] ..... G04B 49/04

[52] U.S. Cl. ..... 33/270

[58] Field of Search ..... 33/269, 270, 271, 268; 58/3

[56] References Cited

U.S. PATENT DOCUMENTS

| | | | |
|---|---|---|---|
| 89,585 | 5/1869 | Johnson . | |
| 196,550 | 10/1877 | Anderson . | |
| 281,527 | 7/1883 | Larsen . | |
| 552,002 | 12/1895 | Rice . | |
| 783,245 | 2/1905 | Clarke | 33/270 |
| 794,787 | 7/1905 | Crehore . | |
| 849,475 | 4/1907 | Hewitt . | |
| 853,338 | 5/1907 | Bissell . | |
| 978,859 | 12/1910 | Dick . | |
| 1,674,161 | 6/1928 | Bogory . | |
| 2,033,604 | 3/1936 | Arton . | |
| 3,031,763 | 5/1962 | Jewett | 33/270 |
| 3,158,937 | 12/1964 | Flinos . | |
| 3,417,473 | 12/1968 | Troseth . | |
| 3,786,570 | 1/1974 | Davies . | |
| 3,815,249 | 6/1974 | Gundiach . | |
| 4,081,911 | 4/1978 | Eldridge . | |
| 4,135,357 | 1/1979 | Ashton . | |
| 4,255,864 | 3/1981 | Glendinning | 33/270 |

*Primary Examiner*—William D. Martin, Jr.
*Attorney, Agent, or Firm*—Jones, Tullar & Cooper

[57] ABSTRACT

A columnar sundial utilizing the projection of the spot image of the sun through a nodus plate onto a translucent projection screen is disclosed. The projection screen is mounted on a support column which has a transparent portion through which the spot image is projected, with the nodus plate closing the upper end of the column. The projection screen is movable on the column to permit adjustment for display of seasonal time and date markings, and the nodus plate is provided with a series of apertures, one of which is selectively uncovered in accordance with the latitude at which the sundial is used. The column preferably is cylindrical with an elliptical cross-section, but may be circular in cross-section, and may have a non-cylindrical shaped surface.

19 Claims, 15 Drawing Figures

WINTER / SPRING

SUMMER / FALL

FIG. 11
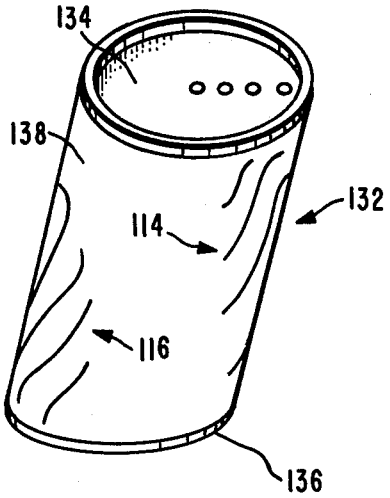
FIG. 12
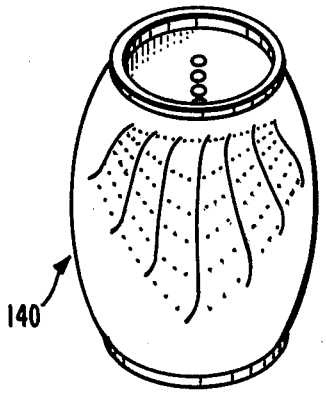
FIG. 13
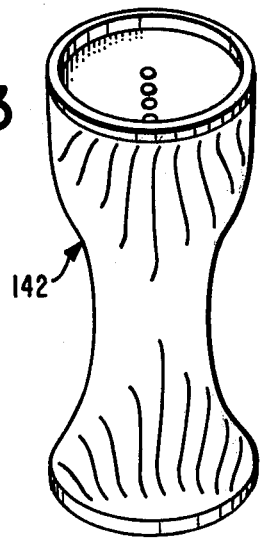
FIG. 14
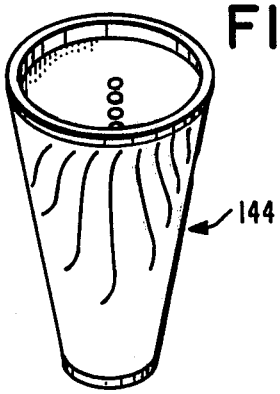
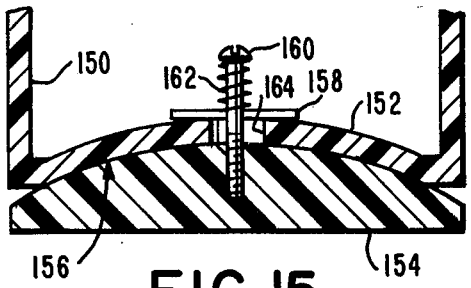
FIG. 15

COLUMNAR SUNDIAL

BACKGROUND OF THE INVENTION

The present invention relates, in general, to sundials, and more particularly to sundials having an improved columnar construction which permits an accurate determination of time and date.

Although spot projection sundials have been known in the art for many years, as evidenced by U.S. Pat. No. 89,585 to Johnson, such devices have not always been satisfactory since they were often difficult to read, and were not suitable for use at a variety of latitudes. In particular, they often could not be used at low or southerly latitudes, where the sun is high at summer solstice, and thus projects almost straight down into the sundial, making it very difficult to obtain a reading. Similarly, at high, or northerly latitudes, the sun is low, and does not project sufficiently far into many sundial devices.

A further problem with prior devices occurred because of the difficulty in making a sundial that would not only be relatively inexpensive, but would be accurate, easy to read and easy for the user to set up.

SUMMARY OF THE INVENTION

Briefly, the present invention is directed to a sundial which includes a support column having a hollow interior and on which is mounted a translucent projection screen. The support column is molded from a plastic material such as an acrylic, with one portion of the support column being opaque and the remainder being transparent, so that a light spot can pass through the interior of the support column, through its transparent portion, and can fall on the interior of the projection screen. The sun spot is produced by means of an opaque nodus plate which forms a closure for the top of the support column, the nodus plate having an aperture through which sunlight passes to produce a sun spot on the interior surface of the support column. By adjusting the location of the aperture in the nodus plate, and by proper orientation of the support column, the sun spot will fall on the transparent portion of the support column and thus will produce an illuminated spot on the projection screen.

The projection screen, which preferably is of transparent, thin vinyl, carries an analemma, or in some embodiments one-half an analemma, onto which the sun spot is projected. A full analemma is a graduated scale which indicates the sun's declination for every day of the year, while a half-analemma provides an indication of the declination for a six month period, either from the winter solstice (December) to the summer solstice (June), or from the summer solstice to the winter solstice. When the sundial is properly oriented, and when the aperture is properly located in the nodus plate, the spot produced by the sun will fall on the analemma and provide an indication of the time of day and the day of the month.

In accordance with the present invention, the support column preferably is elliptical in cross-section to spread the analemma scale thereby to obtain accurate readings, while the projection screen is movably mounted on the support column for the seasonal adjustment which is needed when a half-analemma is used. The nodus plate is provided with a plurality of apertures, only one of which is selected for use to provide an accurate reading for the particular latitude at which the sundial is used. In one form of the invention, the support column is a right cylinder, while in other forms it may be an offset cylinder, an hourglass shape, a truncated cone, or convex, with the base and the top being either circular or elipitcal.

The projection screen may be mounted on the exterior of the support column, and preferably carries at diametrically opposed locations the two half-analemmas which are used for the sundial. One half may be inverted, if desired, so that the projection screen must be inverted, as well as rotated 180° to display one or the other of the two half-analemma scales.

BRIEF DESCRIPTION OF THE DRAWINGS

The foregoing and additional features and advantages of the invention will be more clearly understood from a consideration of the following detailed description of preferred embodiments thereof, taken in conjunction with the following drawings, in which:

FIGS. 11–14 illustrate modified forms of the sundial, and

FIG. 15 illustrates a modified base for the sundial.

DESCRIPTION OF PREFERRED EMBODIMENTS

Figure 1:
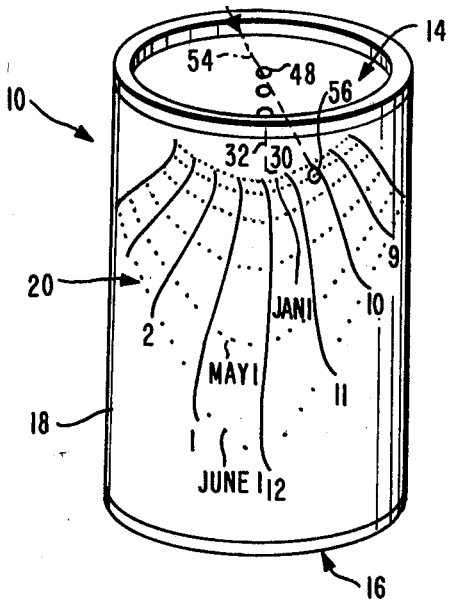
FIG. 1 is a perspective view of a embodiment of the sundial of the present invention, with the projection screen thereof displaying a first half of an analemma scale.
Figure 2:
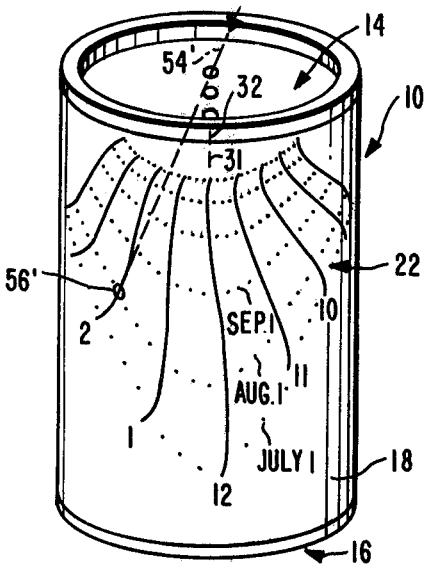
FIG. 2 is a perspective view of the embodiment of FIG. 1, with the projection screen thereof rotated to display a second half of the analemma scale.
Figure 3:
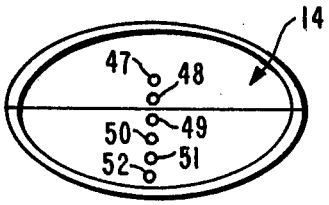
FIG. 3 is a top plan view of the device of FIG. 1.
Figure 4:
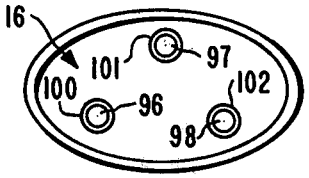
FIG. 4 is a bottom plan view of the device of FIG. 1.

Turning now to a more detailed consideration of the present invention, there is illustrated in FIGS. 1–7 a preferred form of a sundial 10 constructed in accordance with the present invention. The sundial includes a hollow support column 12, at least part of which is transparent, an opaque nodus plate 14 which serves as a closure for the upper end of the support column 12, and a bottom plate 16 which serves as a base for the sundial. Mounted on the outer surface of the support column 12 is a transparent screen 18 which surrounds the support column and which carries two half-analemma scales 20 and 22. The projection screen is mounted for movement with respect to the support column 12 so that the scales 20 and 22 can be aligned with the transparent portion of the column 12, thereby allowing sunlight passing through an aperture in the nodus plate 14 to be projected onto the interior surface of the projection screen 18 to produce an illuminated spot which indicates the time of day.

Figure 5:
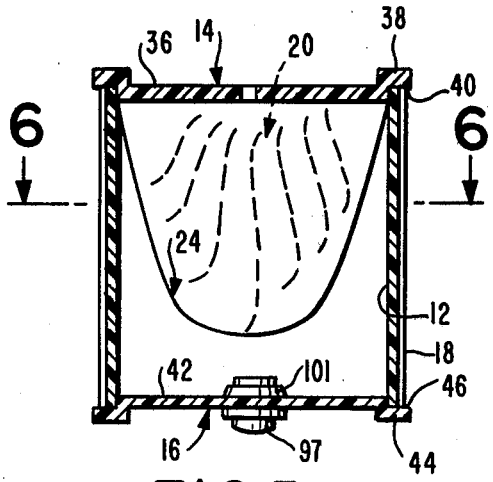
FIG. 5 is a cross-sectional view of the device of FIG. 1, taken along lines 5—5 of FIG. 6.
Figure 6:
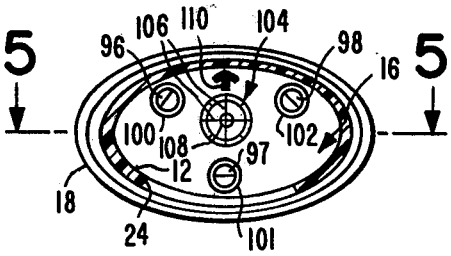
FIG. 6 is a cross-sectional view of the device of FIG. 1, taken along line 6—6 of FIG. 5.

In the preferred form of the invention, the support column 12 is a right cylinder having an elliptical cross-section, as illustrated in FIGS. 1 and 6. Column 12 is molded from a plastic material such as acrylic, with at least a portion thereof being transparent and the remainder being opaque. The transparent portion of column 12 corresponds to the dimensions of one of the scales 20 and 22 carried on the projection screen 18, so that a selected scale can be aligned with a transparent part of the column. The support column 12 may be molded from a transparent plastic material and the interior coated with an opaque layer such as black paint, or the like, except in an area corresponding in size and shape to the scales 20 and 22 in FIG. 1 or 2. Alternatively, the support column may be made from an opaque plastic with a transparent portion 24 being formed by cutting away the opaque plastic in the manner illustrated in FIGS. 5 and 6. The size and shape of the transparent portion is selected so that a beam of light shining into the interior of the support column will illuminate only that portion of the projection screen which overlies the transparent portion.

Figure 7:
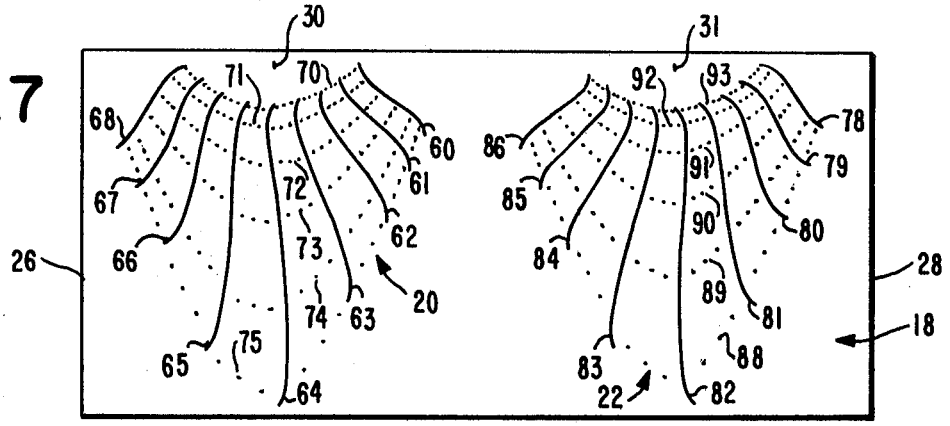
FIG. 7 illustrates the analemma scales on the projection screen of FIG. 1.

As illustrated in FIG. 7, the two scales 20 and 22 which are carried by the projection screen 18 preferably are displayed at spaced locations on a single sheet of translucent material such as paper, vinyl or the like. This sheet is wrapped around the support column in the manner illustrated in FIGS. 1 and 2, with its vertical edges 26 and 28 being joined as by heat welding, adhesives, or the like to form a cylinder which fits on the exterior surface of the support column 12, but sufficiently loosely to permit the projection screen to be rotated about the support column so that either the scale 20 or the scale 22 can be aligned with the transparent portion 24. If desired, alignment marks 30 and 32 may be provided on the projection screen to align with a similar mark 34 on the support column or the nodus plate 14 to insure proper alignment of the scales with the transparent portion 24.

Figure 9:
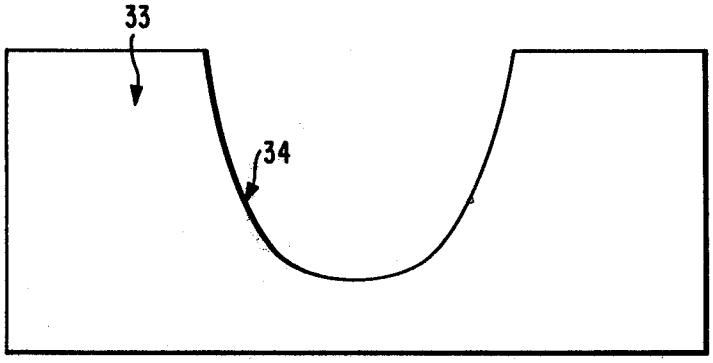
FIG. 9 illustrates an opaque shield for use in the sundial of FIG. 1.

As an alternative, the transparent portion 24 may be provided by forming the support column from clear, transparent material and mounting a shield 33 (FIG. 9) of opaque material, such as heavy paper, on the interior surface thereof. The opaque shield which may incorporate a cutout portion 34 corresponding to transparent portion 24, is FIGS. 5 and 6, is rolled into a cylinder and placed inside the support column so that it may be rotated with respect to the support column to position the cutout portion on one side or the other under either the scale 20 or the scale 22, located on opposite sides of the support column. In this embodiment, the scales 20 and 22 may be formed directly on the outer surface of the column 12, or may be carried by an outer projection screen in the manner illustrated in FIGS. 1 and 2.

The scales 20 and 22 carried by projection screen 18 are spaced apart so as to appear approximately on opposite sides of the support column when the projection screen is mounted thereon. Thus, the scale 20 appears on the forward side of the support column, aligned with the transparent portion 24, with scale 22 then being located at the rear of the support column as viewed in FIG. 1, opposite to the location of scale 20. Rotation of the projection screen approximately 180° brings the scale 22 into alignment with the transparent portion 24, with the scale 20 then being on the rear surface of the support column. It will be apparent that the two scales need not be arranged diametrically opposite each other when mounted on the support column, but such an arrangement is not only convenient, but provides a maximum display area for the elliptical support column.

The opaque nodus plate 14 is elliptical in shape and forms a cover for the upper end of the support column 12. As illustrated in FIG. 5, plate 14 includes a flat central portion 36 which fits snugly inside the upper end of support column 12 and an upstanding flange portion 38 which extends outwardly and over the upper edge of support column 12. The flange portion 38 cooperates with the upper edge of column 12 to define an upper shoulder 40. In similar manner, the lower base plate 16 includes a planar central portion 42 which fits snugly within the bottom of support column 12. Plate 16 also has an upstanding flange portion 44 which overlies the bottom edge of the support column and cooperates therewith to form a lower shoulder 46. The upper lower shoulders 40 and 46 provide upper and lower guide edges for the projection screen 18, holding the screen in position on the support column.

The upper nodus plate 14 includes a series of node or apertures 47–52 which are arranged along an axis through the center of the nodus plate to the edge thereof, preferably in alignment with the mark 34 (FIG. 1) and thus centrally located with respect to the transparent portion 24 of the support column. In use, only one of the apertures 47–52 is opened to allow light 54 from the sun to form a pinhole image 56 of the sun on the interior surface of the support column. By proper alignment of the sundial and proper selection of the aperture to be used, the pinhole image will fall on the rear surface of the projection screen 18. It will be understood that at different times of the day, and at different times of the year, the sunlight 54 and 54' illustrated in FIGS. 1 and 2, will enter the selected one of node apertures 47–52 at different angles, thus producing the node aperture image 56 or 56' at different locations on the interior surface of the support column and thus on different portions of the scale 20 or 22, whichever is in position for display.

Scale 20 and 22 are conventional half-analemma scales, scale 20 having generally vertical lines 60–68 corresponding to the hours of the day, with line 64 corresponding to noon, and generally horizontal lines 70–75 representing months of the year, line 70 of scale 20 corresponding to the first day of January and line 75 corresponding to the first day of June. In similar manner, scale 22 incorporates generally vertical hour lines 78 through 86 and generally horizontal month lines 88–93 representing the first day of the months July through December, respectively. Each of the half-analemma lines 60–68 and the half-analemma lines 78–86 are obtained by calculating a line of projection from the sun through a selected node aperture and onto the inner wall of the support column 12, and thus onto the inner surface of the projection screen 18. These projections are made each hour for each day of the year, for the particular size and shape of the sundial and for the latitude and longitude at which it will be used, and the points are plotted to provide the curved analemma lines.

The generally horizontal lines 70–75 and 88–93 indicate the location of the sun's position on the first day of each month, and these lines are plotted in the form of discrete dots to permit interpolation of the minutes between the hours represented by the generally vertical analemma lines. The day of the month for a particular projection can be interpolated by the location of a projected image of the sun between the generally horizontal lines. The scale 20 presents the plotted projections for the time period from the winter solstice to the summer solstice (December–June) while the scale 22 represents the projections for the time period from the summer solstice to the winter solstice (June–December).

The base plate 16 preferably includes several adjustable feet 96, 97 and 98 which, for example, may be threaded through corresponding bushings 100, 101 and 102, respectively, whereby the height of the support feet can be easily adjusted to level the base 16 on which the sundial rests. To assist in leveling the sundial, the base plate 16 may carry on its upper surface a small bubble-type level 104 (see FIG. 6). Such a level may carry cross-hairs 106 which will indicate that the base plate is level when the bubble 108 is centered on the cross-hair intersection.

In order to properly orient the sundial, a directional arrow 110 may be printed or embossed on the base plate 16. The sundial is properly oriented when the arrow points due south.

In use, the sundial of the present invention is placed on a flat surface and leveled, with the indicator arrow 110 pointing south, and the appropriate one of the scales 20 and 22 is aligned with the transparent portion 24 of the support column. Only one of the node apertures 47–52 is open, the particular aperture depending upon the geographical latitude, the diameter and height of the support column and like characteristics of the sundial. When sundial falls on the cylinder, a pinhole of light will pass through the selected aperture and an image of the sun will fall on the interior surface of the projection sheet 18. By interpolating the location of the spot image, the date and time of day can be determined, the date being an interpolation based on the distance of the spot from the line corrsponding to the first day of the month and the time of day being based on an interpolation of the distance of the spot away from the generally vertical hour lines. In the preferred form of the invention, the generally horizontal date lines are formed by a series of three dots between each of the vertical lines so that the date lines also serve as indicators of 15 minute intervals to facilitate reading the time. If the scale 20 is first aligned with the transparent portion 24 of the support column, then at the summer solstice, the projection screen is rotated with respect to the support column to bring the scale 22 into alignment.

Figure 8:
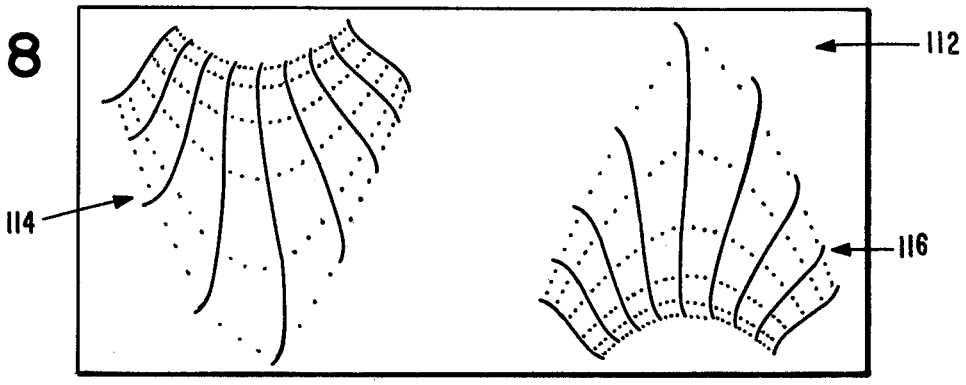
FIG. 8 illustrates a modified form of the scales on the projection screen of FIG. 7.

An alternate form of the analemma scales used on projection screen 18 is illustrated in FIG. 8, wherein the projection screen 112 is illustrated as having a pair of half-analemma scales 114 and 116. Scale 114 is indentical to scale 20 in FIG. 7, while scale 116 is identical to scale 22 with the exception that it is inverted. Such a scale may conveniently be used by simply removing the projection screen from the support column, inverting the screen, and replacing it. Alternatively, the screen 112 may be used with a support column having a transparent portion behind each scale and having a nodus aperture on both the nodus plate 14 and on the base plate 16. With such an arrangement, the chart being displayed can be changed merely by inverting the support column.

Figure 10:
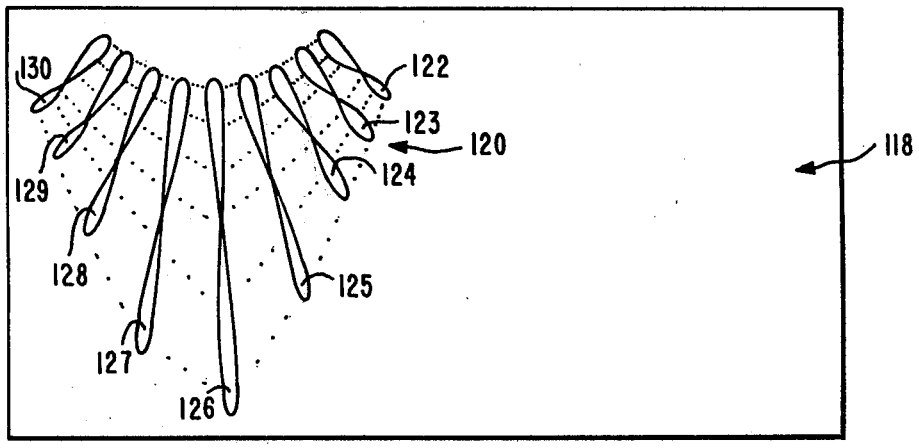
FIG. 10 illustrates another analemma scale for use on the projection screen of FIG. 7.

Another version of the invention is illustrated by the projection screen 118 of FIG. 10, which carries a single full analemma scale 120. This scale combines the hour curves 60–80 from chart 20 and the hour curves 78–86 of chart 22, thereby providing curves 112 through 130 of generally FIG. 8 configuration. These curves represent projections of the pin spot image of the sun at selected hours throughout the entire year. Although this chart has the advantage of eliminating the need to adjust the projection screen every six months, it nevertheless has the disadvantage of being more difficult to read than the half-analemma scales previously illustrated.

Although the invention preferably is in the form of a right cylinder having the elliptical cross-section illustrated in FIG. 1, nevertheless other configurations are possible and have certain advantages. Thus, for example, the sundial may be in the shape of an offset cylinder 132 illustrated in FIG. 11. In that case, the top nodus plate 134 is offset from the base plate 136 and the support column and its super-imposed projection screen 138 takes the form of the offset cylinder illustrated. Again, the sundial may have an elliptical cross-section, or its cross-section may be circular. In this case, the sundial is illustrated with the inverted scales 114 and 116 discussed with respect to FIG. 8, although the analemma scales of FIGS. 7 or 10 may also be used.

Other variations in the shape of the sundial are illustrated in FIGS. 12, 13 and 14, which show a convex support column and projection screen 140, and hourglass-shaped support column and projection screen 142, and a truncated cone-shaped support column and projection screen 144. In each of these cases, the particular shape of the projection screen surface dictates the exact shape of the analemma scale and the location of the nodus aperture so that an accurate projection of the time and date is obtained. Shapes such as the offset cylinder of FIG. 11 and the conical shape of FIG. 14 are particularly useful in low latitude areas, where the sun is located high in the sky and the pinhole projection tends to be almost vertical at certain times of the year. In such a case, if the sundial is a right cylinder, it would have to be very tall, with the scale extended in a vertical direction in order to provide the desired readings. This problem can be overcome by offsetting the cylinder in the manner illustrated in FIG. 11, or by curving or sloping the side walls of the support column in the manner illustrated in FIGS. 13 and 14.

Another variation in the sundial structure is illustrated in FIG. 15, wherein the support column 150 is formed with a concavely curved bottom wall 152. A base unit 154 is provided, on which the support column rests, the base unit having a convexly curved upper surface 156 which matches the curvature of the bottom wall 152. The column is secured to the base by means of a spring-loaded washer 158 held against wall 152 by means of a screw 160 threaded into the base unit 154. A spring 162 surrounds the shaft of screw 160 and is compressed between the head of the screw and the top surface of the washer.

Screw 160 passes through an aperture 164 in the bottom wall 152 which is appreciably larger than the screw so that upon loosening the screw the support column 150 can be adjusted with respect to the base to compensate for the slope of the surface on which the base 154 rests so that the axis of support column 150 will be vertical. Thus, the sundial may be placed in the desired location, the screw 160 loosened and the pitch of the sundial adjusted to make it vertical. A small level may be used for this purpose or a suitable leveling bubble may be incorporated in the cylinder 150. The sundial may be rotated to align the spot image of the sun with the correct time and date, and the screw then tightened to secure the support column on the base. The curved surface of the base unit preferably is sperical to permit rotation of the column 150 with respect to the base, but other shapes may be used, if desired.

Thus, there has been disclosed a sundial which utilizes the projection of a spot image of the sun through a nodus plate onto a translucent projection screen. The time and date may read directly from the position of the spot in relation to the hour and minute markings on the screen, which markings are calculated for the latitude and longitude of the installation of the sundial and for the particular shape of the projection screen. The time and date markings for the period from winter solstice to summer solstice are confined to one half of the projection screen and those for the period from summer solstice to winter solstice are on the other half of the screen. The change between these scales can be accomplished by rotating the screen 180° in one form of the invention or by rotating the screen and by inverting it, in other forms. The fully corrected placement of time and date markings allows very accurate determinations of the standard time and date, while the separation of the marks into 6 months intervals allows ease of reading of the scale face. Initial setup and calibration of the sundial is accomplished merely by placing the dial on the level surface or by adjusting the base plate to be level and rotating the whole device until its indicator arrow points south or the dial reads the correct time.

Since all corrections for the equation of time, latitude, longitude and projection characteristics of the sundial are allowed for in the plotting of the analemmic hour lines and date markings, no further corrective adjustments or tabular corrections are needed for the reading of the time and date.

Although the invention has been described in terms of preferred embodiments thereof, it will be understood that additional variations may be made without departing from the true spirit and scope thereof, as set forth in the following claims:

What is claimed is:

1. A sundial comprising:

a hollow support column having a transparent portion;

a translucent projection screen movably mounted on the exterior surface of said support column, said screen carrying analemma scale means; and an opaque nodus plate covering the upper end of said support column, said nodus plate having a node aperture for projecting a pinhole image of sunlight through said transparent portion of said support column onto the interior surface of said projection screen.

2. The sundial of claim 1, wherein said support column is cylindrical and is elliptical in cross-section.

3. The sundial of claim 1, wherein said support column is an offset cylinder.

4. The sundial of claim 3, wherein said support column is elliptical in cross-section.

5. The sundial in claim 1, wherein said support column is an inverted truncated cone.

6. The sundial of claim 1, wherein said support column is hourglass-shaped.

7. The sundial of claim 1, wherein said projection screen carries two half-analemma scales, and wherein said projection screen is movable with respect to said support column to align a selected scale with said transparent portion of said support column.

8. The sundial of claim 7, wherein one half-analemma scale is inverted with respect to the other.

9. The sundial of claim 1, wherein said projection screen carries a sigle full analemma scale aligned with said transparent portion of said support column.

10. The sundial of claim 1, wherein said support column is opaque, said transparent portion being formed by a cut-away portion of said support column.

11. The sundial of claim 1, wherein said support column is a transparent plastic material, said sundial further including opaque shield means within said support column, said shield means including a cut-away portion corresponding to the shape and size of said analemma scale means.

12. The sundial of claim 1, further including a base plate for said support column, said base plate including leveling means for said sundial.

13. The sundial of claim 12, further including means for directionally orienting said sundial.

14. The sundial of claim 12, wherein said nodus plate and said base plate cooperate with said support column to form upper and lower shoulders, said projection screen being positioned on said support column between said shoulders.

15. The sundial of claim 1, further including a plurality of node apertures in said nodue plate, only one of said apertures being open, the open aperture being selected in accordance with the geographical latitude at which said sundial is used.

16. The sundial of claim 1, further including a bottom wall for said support column and a base unit for supporting said support column.

17. The sundial of claim 16, wherein said bottom wall and said base unit have corresponding curved surfaces, whereby the pitch of said support column may be adjusted with respect to said base unit.

18. The sundial of claim 17, further including biasing means for releasably and adjustably securing said support column on said base unit.

19. The sundial of claim 18, wherein said biasing means includes screw means extending through said bottom wall, and spring means carried by said screw means.

* * * * *